United States Patent [19]

Moss

[11] Patent Number: 4,739,896

[45] Date of Patent: Apr. 26, 1988

[54] AIRCRAFT SERVICING PIT WITH GRAVITY OPERATED LID LATCH

[76] Inventor: Kathyleen D. Moss, 7212 Patterson Dr., Garden Grove, Calif. 92641-1490

[21] Appl. No.: 40,051

[22] Filed: Apr. 20, 1987

[51] Int. Cl.[4] ..... B65D 25/24

[52] U.S. Cl. ..... 220/18; 220/324

[58] Field of Search ..... 220/18, 324

[56] References Cited

U.S. PATENT DOCUMENTS

| | | | |
|---|---|---|---|
| 4,212,410 | 7/1980 | Ealer | 220/324 |
| 4,467,932 | 8/1984 | Dabich | 220/18 |
| 4,535,908 | 8/1985 | Dabich | 220/18 |
| 4,669,625 | 6/1987 | Armstrong | 220/18 |

*Primary Examiner*—George T. Hall

*Attorney, Agent, or Firm*—Charles H. Thomas

[57] ABSTRACT

An access lid for a subsurface aircraft servicing pit is provided with a latch located below a surface across which aircraft roll. The fastening mechanism of the improved subsurface chamber is engaged by the force of gravity when the access lid is closed and when a latch operating element is released. The latch operating element is located in a hand grip cavity, accessible from above and defined beneath the top surface of the lid. Actuation of the operating element overcomes the force of gravity and disengages the latch mechanism. Release of the operating element allows the force of gravity to urge the latch mechanism into an engaged position which prevents the access lid from being opened.

14 Claims, 2 Drawing Sheets

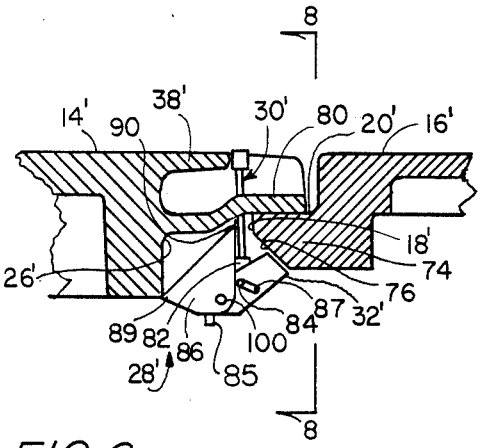
FIG. 6
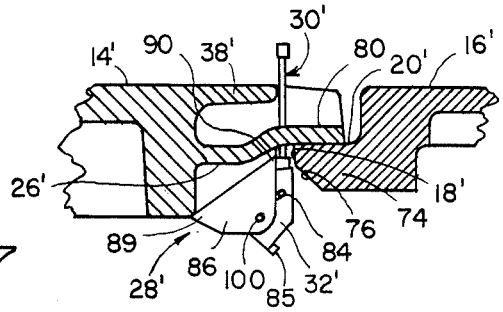
FIG. 7
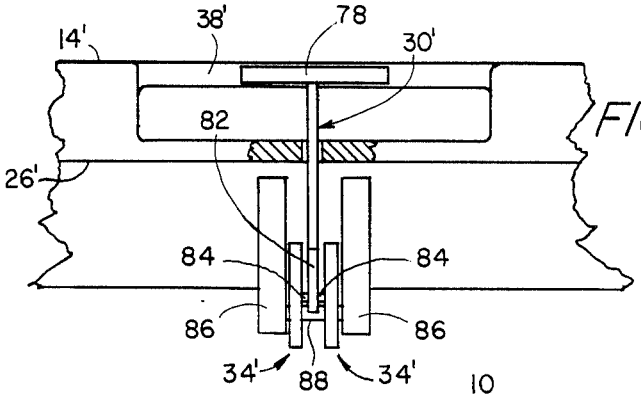
FIG. 8
FIG. 9
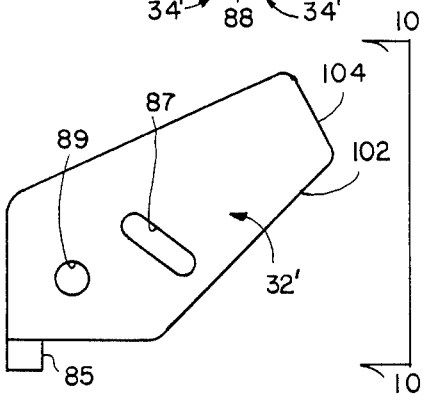
FIG. 10
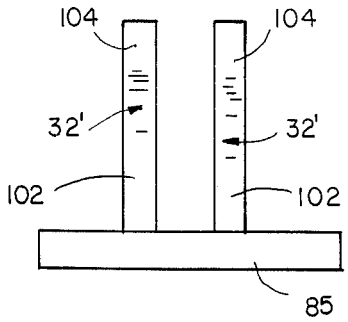

AIRCRAFT SERVICING PIT WITH GRAVITY OPERATED LID LATCH

BACKGROUND OF THE INVENTION

1. Field of the Invention

The present invention relates to a fastening mechanism for an access lid of a subsurface chamber for servicing aircraft.

2. Description of the Prior Art

At modern aircraft terminals the servicing of aircraft on the ground is frequently performed using subsurface pits, which frequently are prefabricated, and which are installed at aircraft docking, fueling and loading areas beneath the surface of the tarmac across which aircraft travel during docking and departure maneuvers. The pits forming the subsurface chambers are typically constructed of fiberglass, steel, concrete or aluminum, and are usually constructed as complete enclosures with surrounding walls, a floor, at least one upright wall, and an access lid at the top of the wall which, when closed, lies substantially flush with the surface of the tarmac. The pits are installed below the surface of loading and refueling aprons at aircraft terminals, remote parking locations and aircraft maintenance bases.

The purpose of the pits is to allow ground support functions to be carried out from subsurface enclosures. These ground support functions include the provision of fuel, the provision of electricity to aircraft in a docking area, the provision of air for cooling an aircraft interior, the provision of pressurized air for starting aircraft engines, and other aircraft support activities on the ground. The use of subsurface pits eliminates the need for mobile trucks, carts and other vehicles which are otherwise present in the loading area and which interfere with the arrival and departure of aircraft in the vicinity of a loading gate. The use of subsurface pits also allows the provision of fuel, power, cooling and pressurized air, and other supplies from a central location. The necessary fluid supplies and electrical power can be generated or stored with great efficiency at a central location and piped or cabled to terminations in the subsurface pits, as contrasted with the use of mobile generating or supply vehicles.

The subsurface pits which are located below the aircraft terminal area house valves, junction boxes, cooling air terminations and other terminal equipment used to service an aircraft that has been docked. Umbilical pipes and lines, otherwise housed within the pits, are withdrawn from the pits through hatches therein and coupled to the docked aircraft to supply the aircraft with fuel, air for cooling the aircraft interior, pressurized air for starting the engines, and electrical power.

The pits are constructed with hinged, disc-like hatches within a more expansive, generally, rectangular or circular lid. The hatches are ordinarily used to withdraw fueling lines and the like, and when properly counterbalanced, can be lifted using one hand. Both the hatches and lids must be constructed of heavy-duty aluminum or steel, or some other strong material, as they must be able to withstand the weight of an aircraft as the tires of an aircraft roll across the docking surface or maintenance pad surface. Larger pit lids for servicing aircraft are frequently counterbalanced in the manner described in U.S. Pat. No. 4,467,932. Counterbalancing a pit lid in this manner allows a lid that weighs many hundreds of pounds to be lifted by a person of ordinary strength using only one hand, with perhaps a force of between only ten and twenty five pounds. Therefore, unless some fastening mechanism is provided the lid is likely to come open when the hatch therewithin is raised.

Because the hatches within the lids must sometimes be lifted and rotated open while the lids themselves remain shut, it is frequently desirable to provide the lids with fastening mechanisms so that the lids will remain closed even while the access hatches therewithin are opened. Conventional lid fastening mechanisms typically employ springs to ensure a positive latching action of the fastening mechanism to releasably secure the lid relative to a frame upon which the lid is hingedly mounted and within which the lid is seated. The spring force normally holds a latch mechanism engaged with a catch. An operating mechanism, mounted in the lid or in the frame is used to overcome the spring force and is manually manipulated to move a latch from an engaged to a disengaged position. The lid can then be lifted and rotated upwardly relatlve to the pit lid frame.

Since subsurface chambers are often exposed to long durations of extreme and hostile weather conditions, conventional spring controlled fastening mechanisms tend to deteriorate with exposure to the elements and, with time, become inoperable. The inoperability of a spring controlled fastening mechanism can sometimes be a very serious problem, since the fastening mechanism is inaccessible from above when the lid is closed. When a spring controlled fastening mechanism malfunctions with the lid in a closed condition, significant time can be expended in freeing the fastening mechanism so that the lid can be raised. Moreover, since the normal, everyday functions of servicing an aircraft are usually performed through the access hatch within the lid, a malfunctioning lid fastening mechanism can go undetected for a lengthy period of time. Moreover, the malfunction is often detected only at the time of an emergency condition when speed in opening the lid to the aircraft servicing pit is vital. For example, the entire lid is frequently opened only during some emergency condition, such as when a fuel line valve breaks. At such a time it is extremely important for maintenance personnel to be able to immediate gain access to the entire pit by opening the entire lid rather than just the hatch within the lid. However, if the fastening mechanism has malfunctioned, the lid can be stuck in the closed position.

SUMMARY OF THE INVENTION

One object of the present invention is to provide a fastening mechanism for the lid of a subsurface chamber for servicing an aircraft which does not rely upon spring loaded latches or any other intricate latch control mechanism. To the contrary, the present invention is directed to a fastening means for an aircraft servicing pit lid which relies entirely upon the force of gravity to create a positive latching action.

Another object of the invention is to provide a fastening mechanism for the lid of an aircraft servicing pit which includes no elements protruding above the top surface of the pit lid, the pit lid frame, or the surface of the tarmac or other surfacing material beneath which the pit is installed. Any upwardly protruding actuating element or member could easily be inadvertently actuated by a person or vehicle crossing the surface, or by an aircraft rolling across the surface. Moreover, any such protruding operating member would be likely to be crushed, and thus disabled, by vehicles or aircraft rolling thereover.

In one broad aspect the present invention may considered to be an improvement to a subsurface chamber that is used for servicing aircraft and which is located beneath a surface across which aircraft roll. A conventional subsurface chamber of this type includes an access lid which is substantially flush with the surface when closed and which is hinged at one side to a frame having at least one upright wall. Such a conventional lid also defines at least one hand grip cavity below its top surface and opposite the hinged side to enable maintenance personnel to get a grip on the edge of the lid in order to rotate it upwardly about the hinge mechanism. According to the improvement of the invention, a releasable fastening mechanism is provided and is formed of an operating element manually movable from a lowered position beneath the top surface to a raised position, and a latch means rotatably mounted relative to the lid. The latch mechanism is urged by gravity to an engaged position and is movable to a disengaged position by the operating element when the operating element is lifted to the raised position.

Different embodiments of fastening mechanisms according to the invention may be desirable, depending upon the configuration and size of the subsurface chamber. Aircraft servicing pits with which the invention may be employed are typically constructed either generally in the form of a rectangular prism or in a cylindrical configuration, and may range from a width of approximately two feet to more than six feet across.

According to one embodiment of the invention, the latch mechanism is formed of a lever having an operating end extending into the hand grip cavity. A catch is mounted on the upright wall of the frame upon which the lid rests. The latch means includes a latch which is rotatably mounted on the lid and is operable by gravity to engage the catch when the operating end of the lever is released and to disengage the catch when the operating end of the lever is raised.

The pit lid may be provided with a plurality of hand grip cavities, any one of which may be utilized to raise a large counterbalanced lid to its open position. Where a pit lid is provided with more than one hand grip cavity, a fastening mechanism is provided in association with each such hand grip cavity. In order that the lid may be opened by manually lifting the lid at any one of the hand grip cavities, the latching members may be joined together to operate in tandem, as by means of a connecting bar, for example. Thus, when the operating element of one fastening mechanism is lifted to a raised position, the latching mechanism associated therewith rotates and in turn rotates a latching mechanism associated with a remote fastener, so that all of the latches are rotated in tandem by the manipulation of a single operating element.

In one embodiment of the invention the fastening mechanism is comprised of an overhang on an upright wall which has a transverse bearing surface that serves as a catch. The latch mechanism engages the bearing surface when the lid is closed and the operating element is in the lowered position. The operating element may be comprised of a vertically oriented rod which is reciprocally mounted perpendicular to the lid and which is coupled to the latch mechanism by means of a sliding coupling. The sliding coupling may be formed of an oblong slot defined in the latch mechanism, which may be a vertically oriented plate rotatably mounted about a horizontal axis at the underside of the lid. Rotation of the latch mechanism is controlled by at least one laterally directed pin extending transversely from the vertically oriented rod and into the slot in the latch in sliding engagement therewith. When the operating rod is lifted vertically upwardly, the latch rotates upwardly and inwardly beneath the lid and out of engagement with the bearing surface of the overhang. The latch will then clear the lip of the overhang when the lid is raised.

In alternative embodiments of the invention the operating means or element may be formed of a lever rigidly joined to the latch mechanism and having an operating end extending into the hand grip cavity. The fastening mechanism is further comprised of a catch plate mounted on the upright wall above which the lid is seated. The catch plate is located for releasable engagement by the latch of the fastening mechanism. The latch is preferably mounted for rotation so as to swing under the force of gravity to a position of engagement with the catch when the lid is closed unless the operating element is moved to a raised position. Together the operating means and the latch means comprise a bell crank structure. When the operating element is moved to a raised position, it carries the latch in rotation against the force of gravity to disengage the latch from the catch.

DESCRIPTION OF THE DRAWINGS

FIG. 6 is a sectional elevational detail of an alternative preferred embodiment of the fastening mechanism of the invention in a position corresponding to that of FIG. 2.

FIG. 7 is a sectional elevational detail of the embodiment of FIG. 6 in a position corresponding to that of FIG. 3.

FIG. 8 is a sectional elevational detail of the fastening mechanism of FIG. 6 shown in isolation and taken along the lines 8—8 of FIG. 6.

FIG. 9 is a side elevational view showing the latch mechanism of the embodiment of FIGS. 6–8 in isolation.

FIG. 10 is an elevational view taken along the lines 10—10 of FIG. 9.

DESCRIPTION OF THE EMBODIMENTS

Figure 1:
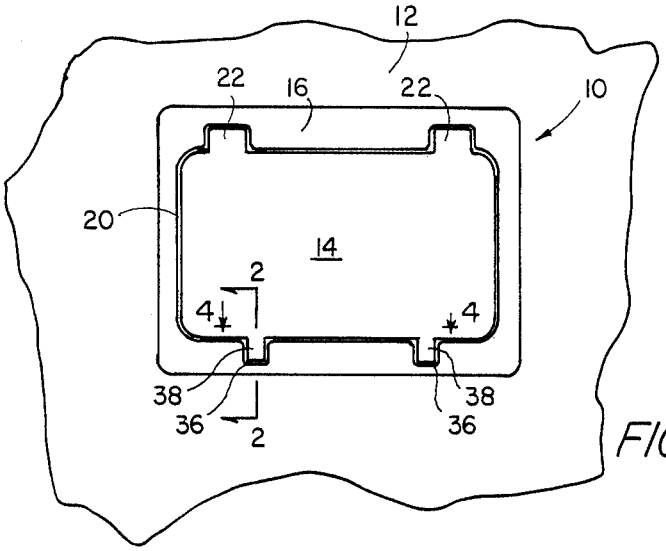
FIG. 1 is a top plan view of a prefabricated pit defining a subsurface chamber according to the invention installed at a surface across which aircraft travel.
Figure 2:
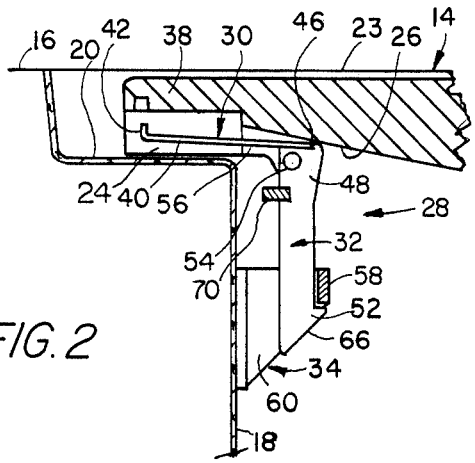
FIG. 2 is a sectional elevational detail taken along the lines 2—2 of FIG. 1 and illustrating one preferred embodiment of a fastening mechanism of the invention in an engaged position.
Figure 3:
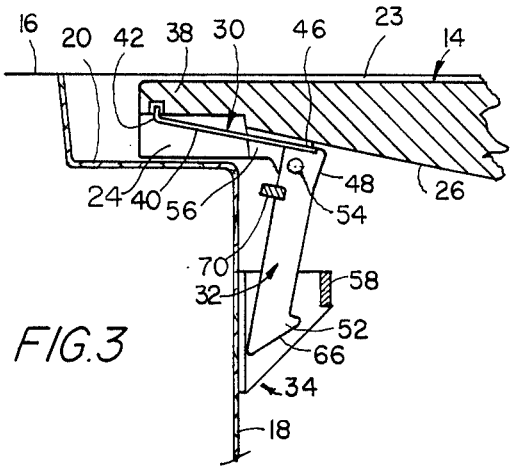
FIG. 3 is a sectional elevational detail showing the fastening mechanism of FIG. 2 in a disengaged position.

FIG. 1 is a top plan view of a prefabricated pit 10 for servicing an aircraft which is mounted to extend beneath a concrete or tarmac surface 12 across which the tires of aircraft roll. The prefabricated pit 10 is formed generally in the configuration of a rectangular prism, and the lid 14 thereof and the surrounding annular frame 16 in which the lid 14 is seated are both mounted substantially flush with the surface 12. As illustrated in FIGS. 2 and 3, the prefabricated pit 10 serves as a subsurface chamber having an upright wall 18 at the top of which the lid 14 is mounted. The lid 14, when closed, seats on a shoulder 20 defined at the interior edge of the frame 16. The lid 14 is mounted to the frame 16 by lid hinges 22. The lid 14, as well as the frame 16, must be capable of withstanding the weight of the tires of an aircraft traveling thereacross, as well as the weight of jeeps, trucks, and other vehicles.

The lid 14 is formed with a pair of lifting flanges 38 which seat in contoured pockets in the shoulder 20. The lifting flanges 38 define a pair of hand grip cavities 24 at the periphery of the lid 14 beneath its top surface 23 and at its undersurface 26 opposite the hinges 22. The improvement of the embodiment of the invention of FIGS. 1–4 resides in the fastening mechanism 28.

The fastening mechanism 28 is formed of an operating element 30 which can be manually lifted to a raised position, as depicted in FIG. 3, by an upward force applied thereto from within the cavity 24. The operating element 30 is otherwise held in a lowered position by the force of gravity, as depicted in FIG. 2. The fastening mechanism 28 also includes a latch 32 which is rotatably mounted at the underside 26 of the lid 14. The force of gravity rotates the latch 32 into engagement with a catch plate 34 to immobolize the lid 14 relative to the upright wall 18 unless the operating element 30 is lifted to its raised position as depicted in FIG. 3. Movement of the operating element 30 to the raised position of FIG. 3 rotates the latch 32 out of engagement with the catch plate 34 and allows the lid 14 to be lifted relative to the frame 16.

The lid 14 seats upon the shoulder 20 of the frame 16 with only a very slight clearance therebetween, except at the hand grip cavities 24, where the clearance 36 between the shoulder 20 and the protruding lifting flanges 38 of the lid 14 provide access to the hand grip cavities 24.

Figure 5:
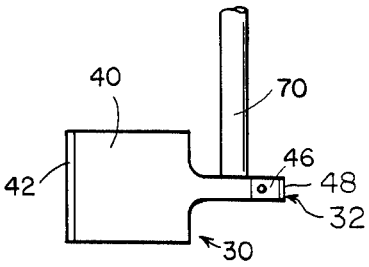
FIG. 5 is a top plan view showing the operating element of the fastening mechanism of FIGS. 1–4 in isolation.

The operating element 30 is depicted in the plan view of FIG. 5. The operating element 30 is a lever which has an operating end 40 formed as a slab of steel approximately four inches in width, the free extremity of which is turned upwardly to form an arcuately curved tip 42. At the other end of the lever 30 there is a thin, actuating finger 46, approximately five and one-quarter inches in length and about one-half inch square and seated on the top of the upper portion 48 of the latch 32. The actuating finger 46 is welded to the top of the latch 32 so that together the lever 30 and the latch 32 form a bell crank structure. The latch 32 is rotatably mounted on an axle rod 54 which is seated in apertures in a pair of ears 45 which depend from the underside 26 of the lid 14.

The latch 32 is formed of a one-half inch thick steel plate and has an upper portion 48 to which the lever 30 is welded. The lower portion of the latch 32 terminates in a generally triangular hook 52. The latch 32 is approximately seven and three-quarter inches in length along its longest dimension. The latch 32 is drilled at its upper extremity to receive a transverse axle 54. The latch 32 is mounted for rotation about the axle 54 at the underside 26 of the lid 14. The axle 54 is seated in apertures in the ears 45 which are located on the opposite sides of the actuating finger 46 and the latch 32.

Figure 4:
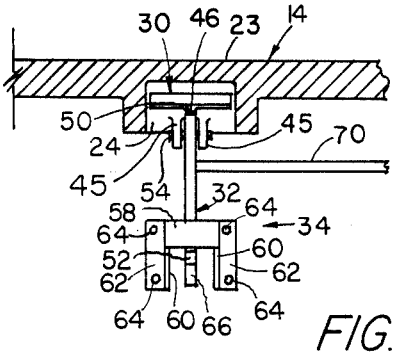
FIG. 4 is a sectional elevational detail taken along the lines 4—4 of FIG. 1.
Figure 4:
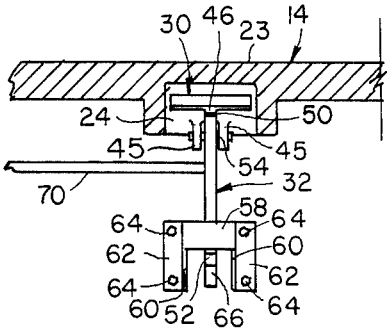

The catch plate 34 is formed of a one-quarter inch steel plate bent to define a central latch engaging bridge 58 supported between a pair of generally triangular-shaped supporting spacers 60. The spacers 60 terminate in outwardly directing flanges 62 which are bolted to the upright wall 18 by means of bolts 64, as depicted in FIG. 4.

The operation of the fastening mechanism 28 is best depicted in FIGS. 2 and 3. The lid 14 is depicted in its normal, closed position in FIGS. 2 and 3. As depicted in FIG. 2, the axle 54 passes through an aperture in the upper portion 48 of the latch 32 which is located off center from the center of gravity of the combined weight of the lever 30 and the latch 32, so that the latch 32 will swing under the force of gravity to the position depicted in FIG. 2 when the lid 14 is closed and unless the operating lever 30 is moved to a raised position. When the lid 14 is closed from an open position to seat upon the shoulder 20 the bridge 58 will first contact the surface 66 of the latch hook 52 as the lid 14 descends. This causes the latch 32 to rotate a short distance in a clockwise direction as viewed in FIGS. 2 and 3, until the hook 52 clears the bridge 58 as the lid 14 continues to swing downwardly. When the lid 14 is fully seated on the shoulder 20, the force of gravity acting on the latch 32 to the left of the axle 54 will cause the latch 32 to swing counterclockwise about the axle 54 until the hook 52 is engaged against the underside of the bridge 58. The latch 32 will then remain fully engaged with the catch 34 in the absence of some force opposing the moment of rotation imparted to the latch 32 by the force of gravity.

When it is desired to raise the lid 14, the user inserts a hand into the enlarged crevice 36, palm up, so that the fingers of the hand enter the hand grip cavity 24 and can be brought to bear against the underside of the plate 40. As the person's hand is raised to lift upon the lifting flange 38 of the lid 14, the upward pressure of the fingers against the plate 40 will cause the operating element 30 to rotate clockwise, as depicted in FIGS. 2 and 3, bringing the curved tip 42 of the lever 30 up into a concave recess in the underside of the liftng flange 38. Clockwise rotation of the operating element 30 will cause the actuating finger 46 to likewise rotate the latch 32 in a clockwise direction, thereby overcoming the force of gravity. As the plate 40 is moved to the raised position within the hand grip cavity 24, as depicted in FIG. 3, the actuating finger 46 rotates the latch 32 in a clockwise direction about the axle 54, thus disengaging the hook 52 from the bridge 58. The release of the hook 52 thus allows the lid 14 to be raised by continued upward pressure on the lifting flange 38 as applied through the plate 40.

As illustrated in FIG. 1, the lid 14 has a pair of lifting flanges 38 which are longitudinally separated from each other along a side of the lid 14 opposite the hinges 22. The lid 14 is equipped with a fastening mechanism 28 at each of the lifting flanges 38. However, it is necessary to operate only a single one of the operating levers 30 in order to release both of the latches 32 because the latches 32 are joined for rotation together about coaxial axles 54 by a connecting bar 70, visible in FIG. 4. The connecting bar 70 is preferably of rectangular cross section and is of a length designed to extend between the latches 32 at each of the lifting flanges 38. Thus, upward force on either of the actuating plates 40 at either of the lifting flanges 38 will cause both of the latches 32 to rotate from the engaged position of FIG. 2 to the disengaged position of FIG. 3.

When the lid 14 is closed the bridges 58 of the two catches 34 will cam the latches 32 aside until the hooks 52 have cleared the lower edges of the bridges 58. Since the axis defined by each axle 54 is displaced from the center of gravity of each bell crank structure formed by a lever 30 and the latch 32 welded thereto, gravity will rotate each latch 32 to hold it engaged with the catch 34 when the lid 14 is closed and unless the lever 30 is raised in the manner depicted in FIG. 3.

FIGS. 6 through 10 illustrate an alternative embodiment of the invention which might typically be employed in association with a subsurface chamber of a cylindrical configuration. In the embodiment of FIGS. 6 through 10, the lid 14' of a prefabricated pit may be closed to the position depicted with the peripheral margin of the lid 14' resting upon a shoulder 20' of a frame 16'. At its interior extremity, the shoulder 20' does drop off to an upright wall 18'. However, the upright wall 18' also defines an overhang 74 which has a transverse bearing surface 76 that serves as a catch.

The fastening mechanism 28' of FIGS. 6–10 represents a different embodiment of the invention from the fastening mechanism 28 depicted in FIGS. 1–5. The fastening mechanism 28' is comprised of an operating element 30' in the form of a vertically oriented rod which has a transverse lifting bar 78 thereacross to form a generally T-shaped structure as depicted in FIG. 8. The vertically oriented rod 30' is located outwardly just beyond the extremity of the lifting flange 38', and passes through a vertical aperture which is formed in the outwardly extending peripheral margin 80 of the lid 14'. The lower extremity of the actuating rod 30' terminates in an end fitting 82. A pair of transverse pins 84 project radially outwardly from the rod 30', in opposite directions as depicted in FIG. 8.

The fastening mechanism 28' is further comprised of a pair of vertically oriented latch plates 32', depicted in isolation in FIG. 9. The latch plates 32', are disposed parallel to each other on opposite sides of the vertically oriented rod 30' and are connected together by a transverse connecting bar 85. Each of the plates 32' has an oblong slot 87 defined therethrough and an opening 89 about which the latch plates 32' are rotatably mounted on a transverse axle 100. The transverse pins 84 extend in opposite directions from the actuating rod 30' into the oblong slots 87.

To provide a fulcrum for rotation of the latch plates 32', a pair of generally triangular-shaped spacing plates 86 are provided outside of the latch plates 32'. The spacing plates 86 are joined together by a transverse connecting strap 88, visible in FIG. 8. The spacing plates 86 contact the undersurface 26' of the lid 14' at their corners 89 and 90. When the operating rod 30' is pulled upwardly by means of the transverse handle 78, the spacing plates 86 are brought into immobilized disposition against the underside 26' of the lid 14'. Further upward movement of the operating rod 30' will cause the transverse pins 84 to slide upwardly within the oblong slots 87 of the latch plates 32', thus rotating the latch plater 32' in a counterclockwise direction about the transverse axle 100 from the position depicted in FIG. 6 to the position depicted in FIG. 7. The transverse pins 84 and the slots 87' thus form a sliding coupling between the operating rod 30' and the latch plates 32'.

When the lid 14' is lowered onto the shoulder 20' of the frame 16', the inner extremity of the shoulder 20' will bear against the surfaces 102 of the latch plates 32'. This will cause the latch plates 32' to rotate in a counterclockwise direction about the axle 100, thus forcing the operating rod 30' upwardly and allowing the latch plates 32' to clear the lip of the shoulder 20'. As soon as the latch plates 32' do clear the shoulder lip, gravity causes them to rotate clockwise downwardly about the axle 100 to the position depicted in FIG. 6. In the position of FIG. 6 the surfaces 104 of the latch plates 32' reside in juxtaposition against the transverse bearing surface 76 which serves as a catch on the frame 16'. Thus, the lid 14' cannot be opened while the operating rod 30' remains lowered in the position depicted in FIG. 6. The force of gravity urges the latch plates 32' toward a downward rotation about the axle 100 in a counterclockwise direction, as viewed in FIGS. 6, 7 and 9, because the latch plates 32' are mounted for rotation relative to the underside of the lid 14' at a location offset from their centers of gravity. The force of gravity also acts upon the operating rod 30' so that the handle 78 does not normally protrude above the level of the upper surface of the lid 14'.

To raise the lid 14', a user will grasp the handle 78 and lift upwardly, thereby moving the operating rod 30' vertically upwardly from the position of FIG. 6 to the position of FIG. 7. Since the spacing plates 86 are immobilized against the underside 26' of the lid 14', by virtue of the contact at points 89 and 90, the upward vertical movement of the operating rod 30' will cause the pins 84 to move upwardly as well. The pins 84 slide within the oblong slots 87 of the latch plates 32' to rotate them counterclockwise from the position of FIG. 6 to the position of FIG. 7. When the latch plates 32' reach the position of FIG. 7, they will clear the lip of the shoulder 20'. The lid 14' can then be rotated open about its hinge on the side thereof opposite the peripheral margin 80.

Undoubtedly, numerous variations and modifications of the invention will become readily apparent to those familiar with the design and construction of subsurface aircraft servicing chambers. Accordingly, the scope of the invention should not be construed as limited to the specific embodiments depicted and described, but rather is defined in the claims appended hereto.

I claim:

1. In a subsurface chamber defined below a surface across which aircraft travel and having at least one upright wall at the top of which an access lid capable of withstanding the weight of the tires of an aircraft traveling thereacross is mounted on lid hinge means, and wherein said access lid defines at least one hand grip cavity below its top surface and opposite said hinge means, the improvement comprising a fastening mechanism formed of an operating means on said lid which can be manually lifted to a raised position by an upward force applied thereto from within said cavity and which otherwise is held in a lowered position be the force of gravity and a latch means rotatably mounted at the underside of said lid, whereby movement of said operating means to said lowered position rotates said latch means to immobilize said lid relative to said upright wall, and movement of said operating means to said raised position rotates said latch means to allow said lid to be lifted.

2. A subsurface chamber according to claim 1 wherein said fastening mechanism is further comprised of a catch defined on said upright wall and said operating means is comprised of a vertically oriented rod reciprocally mounted relative to said lid and coupled to said latch means by a sliding coupling.

3. A subsurface chamber according to claim 2 wherein said sliding coupling is comprised of at least one oblong slot defined in said latch means and at least one pin extending transversely from said vertically oriented rod and into said slot in sliding engagement therewith.

4. A subsurface chamber according to claim 3 wherein said latch means is comprised of a pair of vertically oriented plates disposed parallel to each other on opposite sides of said vertically oriented rod, each of said plates having an oblong slot as aforesaid, and further comprising a pair of pins as aforesaid extending in opposite directions from said rod and into said slots.

5. A subsurface chamber according to claim 2 further comprising spacing means seated against said underside of said lid and defining an axis of rotation for said latch means spaced a predetermined distance beneath said underside of said lid and laterally offset from said vertically oriented rod.

6. A subsurface chamber according to claim 1 wherein said operating means is formed of a lever rigidly joined to said latch means and having an operating end extending into said hand grip cavity, and said fastening mechanism is further comprised of a catch plate mounted on said upright wall for releasable engagement by said latch means.

7. A subsurface chamber according to claim 6 wherein said latch means is mounted for rotation so as to swing under the force of gravity to a position of engagement with said catch plate when said lid is closed unless said operating means is moved to said raised position.

8. A subsurface chamber according to claim 1 wherein said operating means and said latch means together comprise a bell crank structure, rotatably mounted between a pair of ears depending from said underside of said lid and having an operating end extending into said hand grip cavity and an opposite actuating end for moving said latch means in rotation, and said fastening mechanism is further comprised of a catch plate secured to said upright wall, and said latch means includes a hook that is engageable with said catch plate.

9. A subsurface chamber according to claim 8 wherein said lid includes a plurality of hand grip cavities, each of which is equipped with a fastening mechanism as aforesaid, and further comprising a connecting bar joining the latch means of said fastening means together so that they rotate in tandem.

10. In a subsurface aircraft servicing chamber located below a surface across which aircraft travel and having at least one upright wall at the top of which an access lid capable of withstanding the weight of the tires of an aircraft traveling thereacross is mounted on lid hinge means, and wherein said access lid defines at least one hand grip cavity below its top surface and opposite said hinge means, the improvement comprising a releasable fastening mechanism formed of a lever mounted for rotation relative to said lid and having an operating end extending into said hand grip cavity, a catch mounted on said upright wall, and a latch rotatably mounted on said lid and operable by gravity to engage said catch when said operating end of said lever is released and to disengage said catch when said operating end of said lever is raised.

11. A subsurface chamber according to claim 10 wherein said latch is mounted for rotation relative to said lid about an axis displaced from the center of gravity of said latch, whereby gravity rotates said latch to hold it engaged with said catch when said lid is closed and unless said lever is raised.

12. In a subsurface chamber for servicing aircraft and located beneath a surface across which aircraft roll and including an access lid which is flush with said surface when closed and which is hinged at one side to a frame having at least one upright wall and which defines at least one hand grip cavity below its top surface and opposite said hinged side, the improvement comprising a releasable fastening mechanism formed of an operating element manually moveable from a lowered position beneath said top surface to a raised position, and a latch means rotatably mounted relative to said lid and which is urged by gravity to an engaged position and which is moveable to a disengaged position by said operating element when said operating element is lifted to said raised position.

13. A subsurface chamber according to claim 12 wherein said upright wall defines an overhang which has a transverse bearing surface that serves as a catch, and said latch means engages said bearing surface when said lid is closed and said operating element is in said lowered position.

14. A subsurface chamber according to claim 12 further comprising a catch plate on said upright wall and said latch means engages said catch plate when said lid is closed and said operating element is in said lowered position.

* * * * *